US010753026B2

(12) United States Patent
Yandamuri et al.

(10) Patent No.: US 10,753,026 B2
(45) Date of Patent: Aug. 25, 2020

(54) WASHING MACHINE APPLIANCE

(71) Applicant: Haier US Appliance Solutions, Inc., Wilmington, DE (US)

(72) Inventors: Manidhar VVS Yandamuri, Hyderabad (IN); Hanuman Devadatha Seela, Hyderabad (IN); Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 226 days.

(21) Appl. No.: 15/900,879

(22) Filed: Feb. 21, 2018

(65) Prior Publication Data

US 2019/0257016 A1 Aug. 22, 2019

(51) Int. Cl.

| | |
|---|---|
| ***D06F 17/04*** | (2006.01) |
| ***D06F 39/08*** | (2006.01) |
| ***D06F 39/12*** | (2006.01) |
| ***D06F 23/04*** | (2006.01) |

(52) U.S. Cl.

CPC ..... *D06F 17/04* (2013.01); *D06F 23/04* (2013.01); *D06F 39/083* (2013.01); *D06F 39/088* (2013.01); *D06F 39/12* (2013.01)

(58) Field of Classification Search

CPC ..... D06F 17/04; D06F 23/04; D06F 39/083; D06F 39/088; D06F 39/12

See application file for complete search history.

(56) References Cited

U.S. PATENT DOCUMENTS

| | | | | |
|---|---|---|---|---|
| 3,335,584 | A * | 8/1967 | Urban | D06F 39/088 68/207 |
| 7,677,062 | B2 | 3/2010 | Zaccone et al. | |
| 9,340,915 | B2 | 5/2016 | Kim et al. | |
| 2005/0072194 | A1* | 4/2005 | Ryohke | D06F 19/00 68/3 R |
| 2015/0275412 | A1* | 10/2015 | Kim | D06F 37/18 68/27 |
| 2015/0275413 | A1* | 10/2015 | Kim | D06F 37/18 68/27 |
| 2016/0102425 | A1* | 4/2016 | Scheckelhoff | D06F 29/00 68/13 R |
| 2016/0122933 | A1 | 5/2016 | Pollett | |
| 2018/0340287 | A1* | 11/2018 | Carpenter | D06F 39/12 |
| 2019/0010657 | A1* | 1/2019 | Uim | D06F 37/42 |

* cited by examiner

*Primary Examiner* — Joseph L. Perrin
(74) *Attorney, Agent, or Firm* — Dority & Manning, P.A.

(57) ABSTRACT

A washing machine appliance includes a cabinet having a top panel defining an aperture, a wash tub mounted within the cabinet below the top panel and configured for containing fluid during operation of the washing machine appliance, and a wash basket rotatably mounted within the wash tub directly below the aperture of the top panel. The wash basket defines a wash chamber configured for receiving laundry articles via the aperture in the top panel. A door is mounted to the cabinet at the top of the top panel. A pretreatment area is defined in the top panel between the door and the aperture. An elongated nozzle is positioned in the top panel proximate to and below the door. The elongated nozzle is configured to provide a sheet flow of wash fluid over the pretreatment area.

10 Claims, 12 Drawing Sheets

WASHING MACHINE APPLIANCE

FIELD OF THE INVENTION

The present subject matter relates generally to washing machine appliances, and in particular to washing machine appliances including features for providing a flow of wash fluid to a pretreatment area in the washing machine appliance.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

One issue with many conventional washing machine appliances is that consumers have no place to pretreat articles before washing. In many conventional washing machine appliances, there is not an adequate surface or component on which to perform pretreat activities. Accordingly, such activities must be performed in a separate utility sink, a kitchen sink, or in another suitable location using apparatus separate from the washing machine appliance. In addition, such pretreatment activities require a separate, dedicated source of pretreatment detergent, water, or other wash fluid for applying to the clothing during the pretreatment process. This can be inconvenient and time-consuming for the consumer.

Accordingly, a washing machine appliance having improved features for pretreating articles of clothing is desirable. More particularly, a washing machine appliance with an integrated pretreating platform or surface and features for supplying a wash fluid onto the articles of clothing during a pretreatment process would be particularly beneficial.

BRIEF DESCRIPTION OF THE INVENTION

The present subject matter provides a washing machine appliance having a pretreatment area and an elongated nozzle configured to provide a sheet flow of wash fluid to the pretreatment area. Additional aspects and advantages of the invention will be set forth in part in the following description, or may be apparent from the description, or may be learned through practice of the invention.

In one embodiment, a washing machine appliance defining a vertical direction, a lateral direction, and a transverse direction is provided. The vertical direction, the lateral direction and the transverse direction are mutually perpendicular. The washing machine appliance includes a cabinet extending between a top and a bottom along the vertical direction, a wash tub mounted within the cabinet and configured for containing fluid during operation of the washing machine appliance, and a wash basket rotatably mounted within the wash tub. The wash basket defines a wash chamber configured for receiving laundry articles. A top panel is positioned at the top of the cabinet. The top panel extends from a top to a bottom along the vertical direction. A door is mounted to the cabinet at the top of the top panel.

An aperture is defined in the bottom of the top panel. The aperture is positioned directly over the wash basket along the vertical direction. The aperture is sized and configured for passing laundry articles therethrough into the wash chamber of the wash basket. A pretreatment area is defined in the top panel between the door and the aperture along the vertical direction. An elongated nozzle is positioned in the top panel proximate the top of the top panel and below the door. The elongated nozzle is configured to provide a sheet flow of wash fluid over the pretreatment area.

In another embodiment, a washing machine appliance is provided. The washing machine appliance includes a cabinet having a top panel defining an aperture, a wash tub mounted within the cabinet below the top panel and configured for containing fluid during operation of the washing machine appliance, and a wash basket rotatably mounted within the wash tub directly below the aperture of the top panel. The wash basket defines a wash chamber configured for receiving laundry articles via the aperture in the top panel. A door is mounted to the cabinet at the top of the top panel. A pretreatment area is defined in the top panel between the door and the aperture. An elongated nozzle is positioned in the top panel proximate to and below the door. The elongated nozzle is configured to provide a sheet flow of wash fluid over the pretreatment area.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
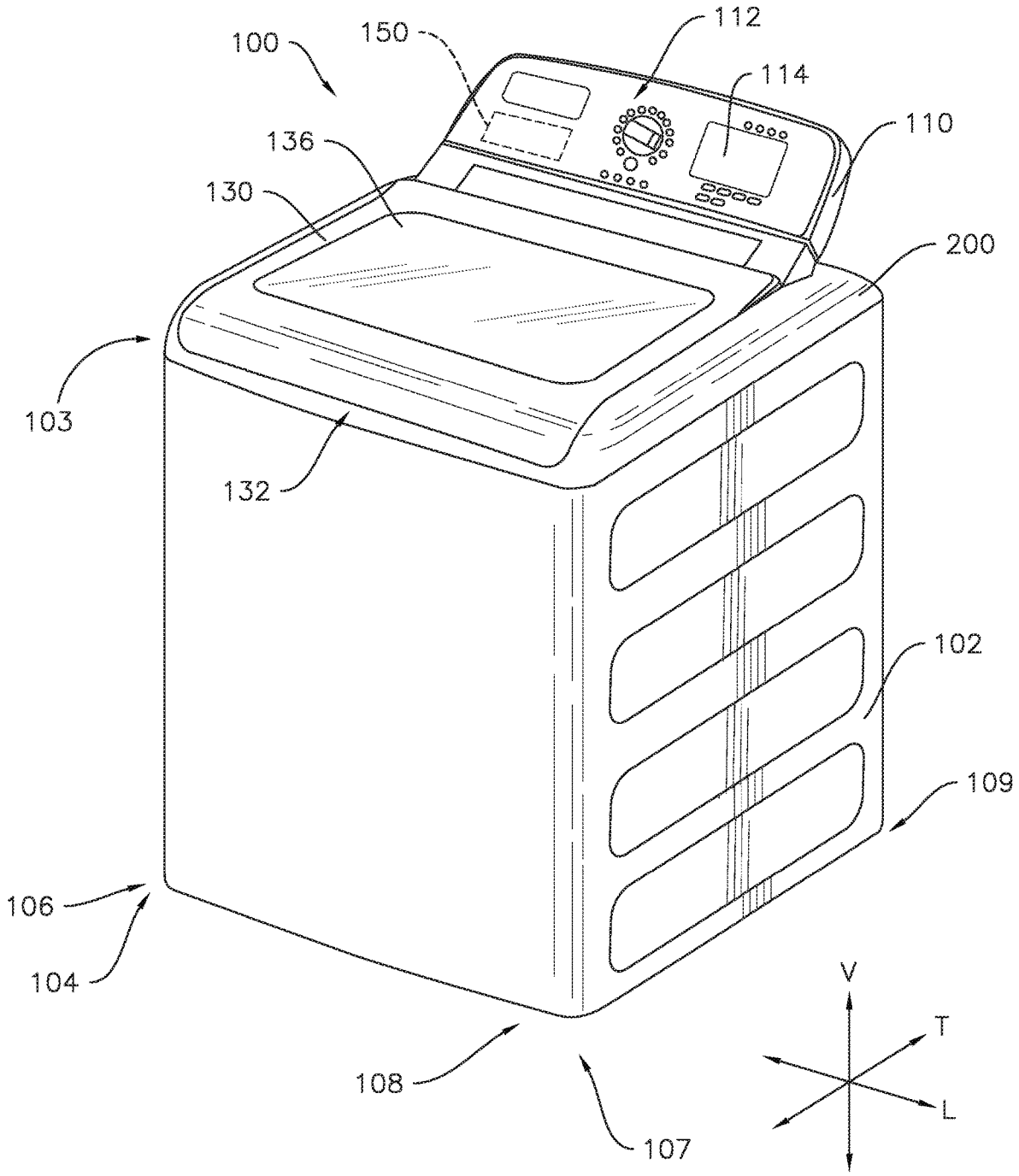
FIG. 1 provides a perspective view of an exemplary washing machine appliance that may incorporate various embodiments of the present subject matter with a door or lid of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction.

Figure 2:
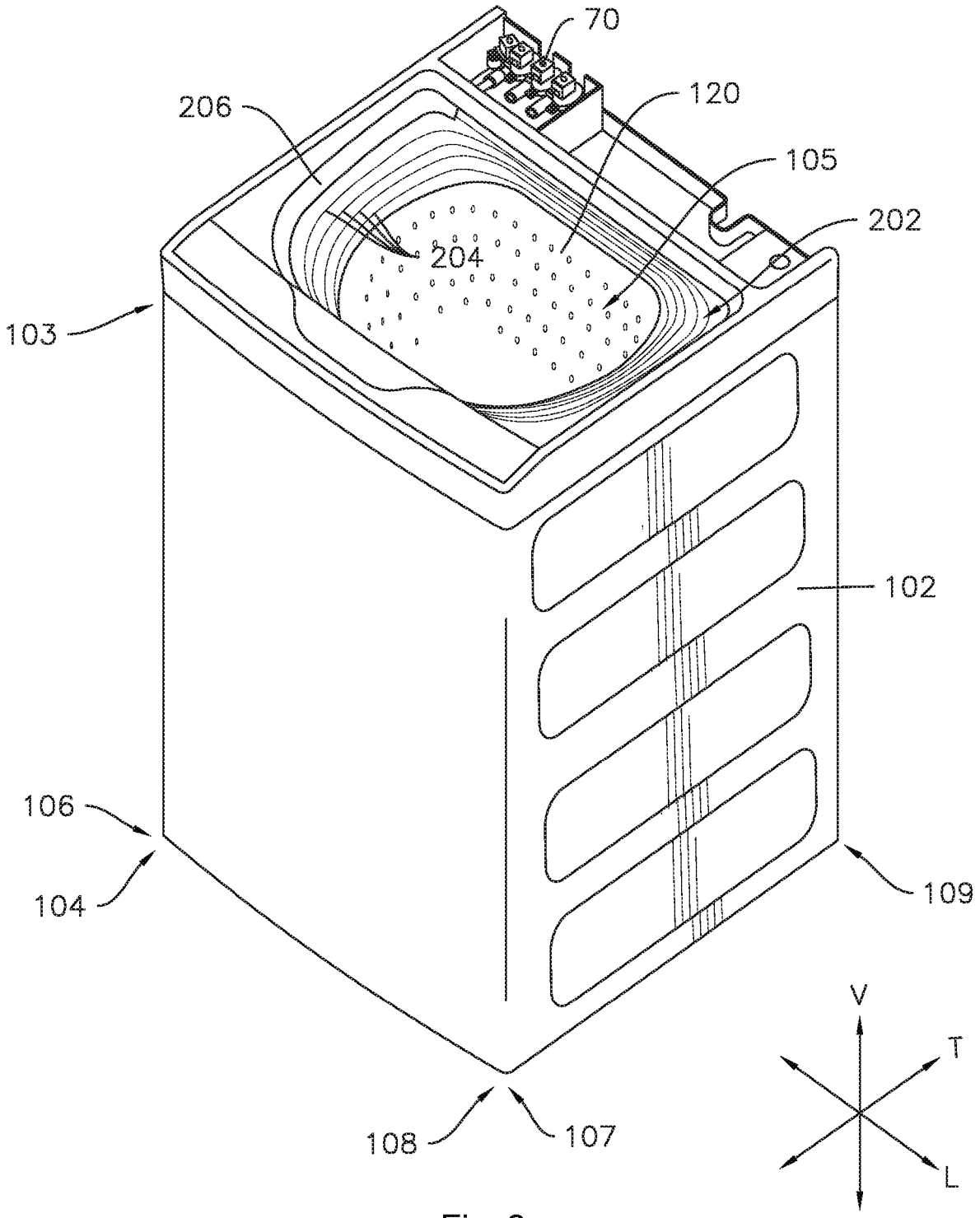
FIG. 2 provides a perspective view of the exemplary washing machine appliance of FIG. 1 with the door and a control panel of the washing machine appliance removed to show certain features of a top panel of the washing machine appliance.
Figure 3:
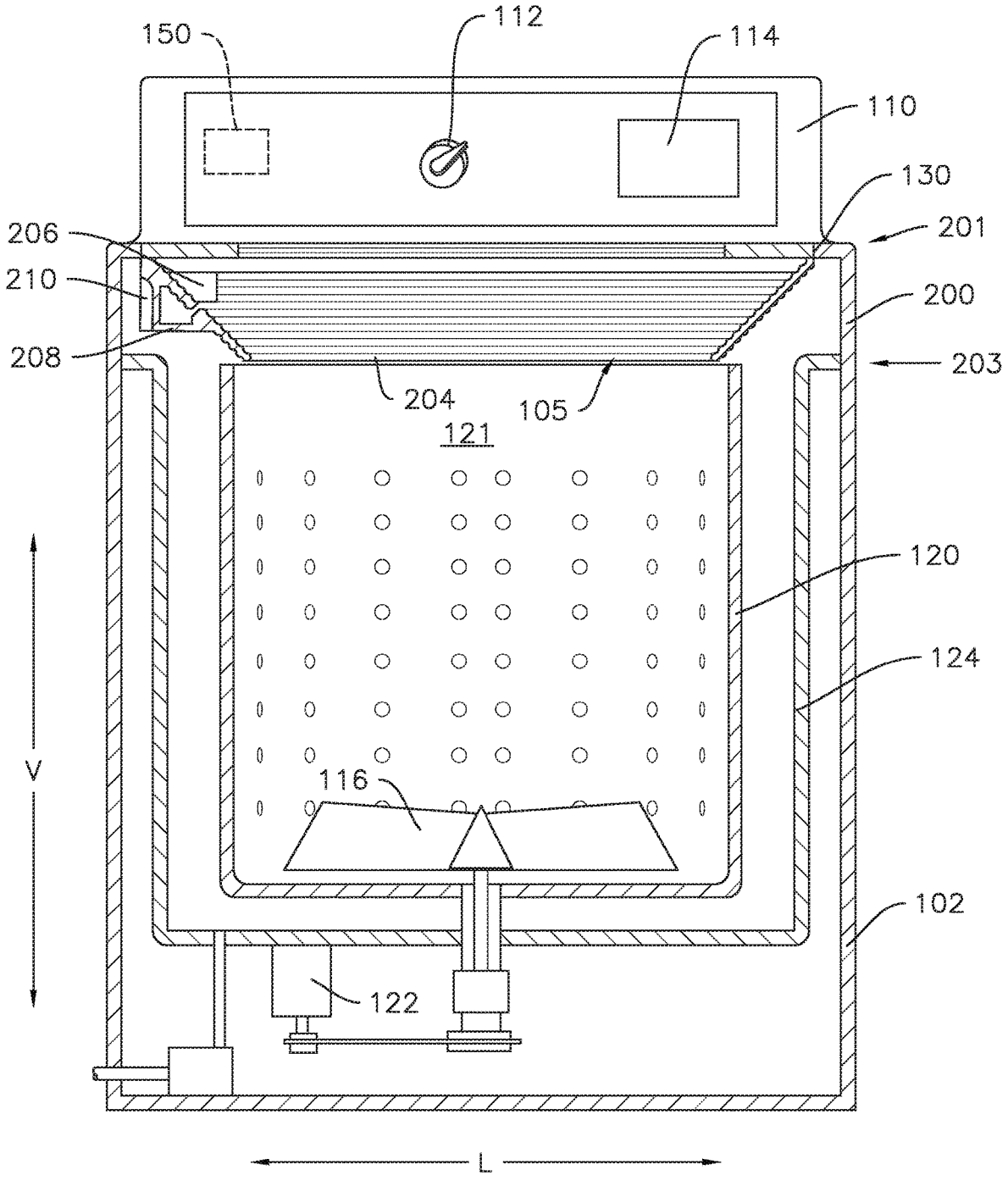
FIG. 3 provides a front section view of the washing machine appliance of FIG. 1.

FIGS. 1, 2, and 3 illustrate an exemplary embodiment of a vertical axis washing machine appliance 100. In FIGS. 1 and 3, a lid or door 130 is shown in a closed position. In FIG. 2, door 130 is removed to more clearly illustrate the top panel 200. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that defines a lateral direction L, a transverse direction T, and a vertical direction V. The lateral direction L, transverse direction T, and vertical direction V are mutually perpendicular and define an orthogonal coordinate system. As shown, cabinet 102 extends between a top 103 and a bottom 104 along the vertical direction V, between a left side 106 and a right side 107 along the lateral direction L, and between a front side 108 and a rear side 109 along the transverse direction T. A wash basket 120 (FIG. 3) is rotatably mounted within cabinet 102. For example, a wash tub 124 (FIG. 3) may mounted within the cabinet 102, as described in more detail below, and the wash basket 120 may be rotatably mounted within the wash tub 124. Wash basket 120 defines a wash chamber 121 (FIG. 3) that is configured for receipt of articles for washing. An agitator or impeller 116 extends from wash basket 120 into wash chamber 121 to assist agitation of articles disposed within wash chamber 121 during operation of washing machine appliance 100. A motor 122 (FIG. 3) is in mechanical communication with agitator 116 in order to selectively rotate agitator 116 within wash basket 120 (e.g., during an agitation or a rinse cycle of washing machine appliance 100). Motor 122 may also be in mechanical communication with the wash basket 120 to selectively rotate the wash basket 120.

Cabinet 102 of washing machine appliance 100 has a top panel 200. Top panel 200 is fixed to the cabinet 102. For example, in some embodiments, the top panel 200 may be integrally joined to the cabinet 102. In various embodiments, the top panel 200 is an integral part of the cabinet 102 and is not movable relative to the cabinet 102. Top panel 200 defines an aperture 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and an open position. In the closed position, door 130 is positioned over the wash tub 124 such that the door 130 encloses the wash tub 124 and inhibits access to wash chamber 121 in the closed position. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

As may be seen, e.g., in FIG. 3, the top panel 200 extends between a top 201 and a bottom 203 along the vertical direction V. In the illustrated exemplary embodiment, the door 130 is mounted to the top panel 200 at the top 201 of the top panel 200 and the aperture 105 is defined in the bottom 203 of the top panel 200. As may be seen in FIGS. 2 and 3, the aperture 105 may be positioned directly over the wash basket 121 along the vertical direction V and in direct communication with the wash basket 121 such that a user may readily transfer items from a pretreatment area 202 defined in the top panel 200 directly to the wash basket 121. Accordingly, the aperture 105 may be sized and configured for passing laundry articles therethrough into the wash chamber 121 of the wash basket 120, e.g., the aperture 105 may be of a sufficient size for at least one laundry article to pass through the aperture 105 and into the wash chamber 121. For example, in some embodiments, the aperture 105 may be approximately the same size as an open top end of the wash basket 120, e.g., within ten percent greater or less than the size of the open top end of the wash basket 120.

As mentioned above, a pretreatment area 202 may be defined in the top panel 200 between the top 201 and the bottom 203 of the top panel 200, e.g., between the door 130 and the aperture 105 along the vertical direction V. The pretreatment area 202 may be corrugated, e.g., a plurality of ridges 204 may be formed in the pretreatment area 202 above the aperture 105. The ridges 204 may extend fully around the pretreatment area 202 so as to fully enclose or encircle the aperture 105, e.g., as seen in the top view of FIGS. 6 and 13. The ridges 204 may be concentrically arranged about the aperture 105, in particular about a centerpoint of the aperture 105.

Figure 4:
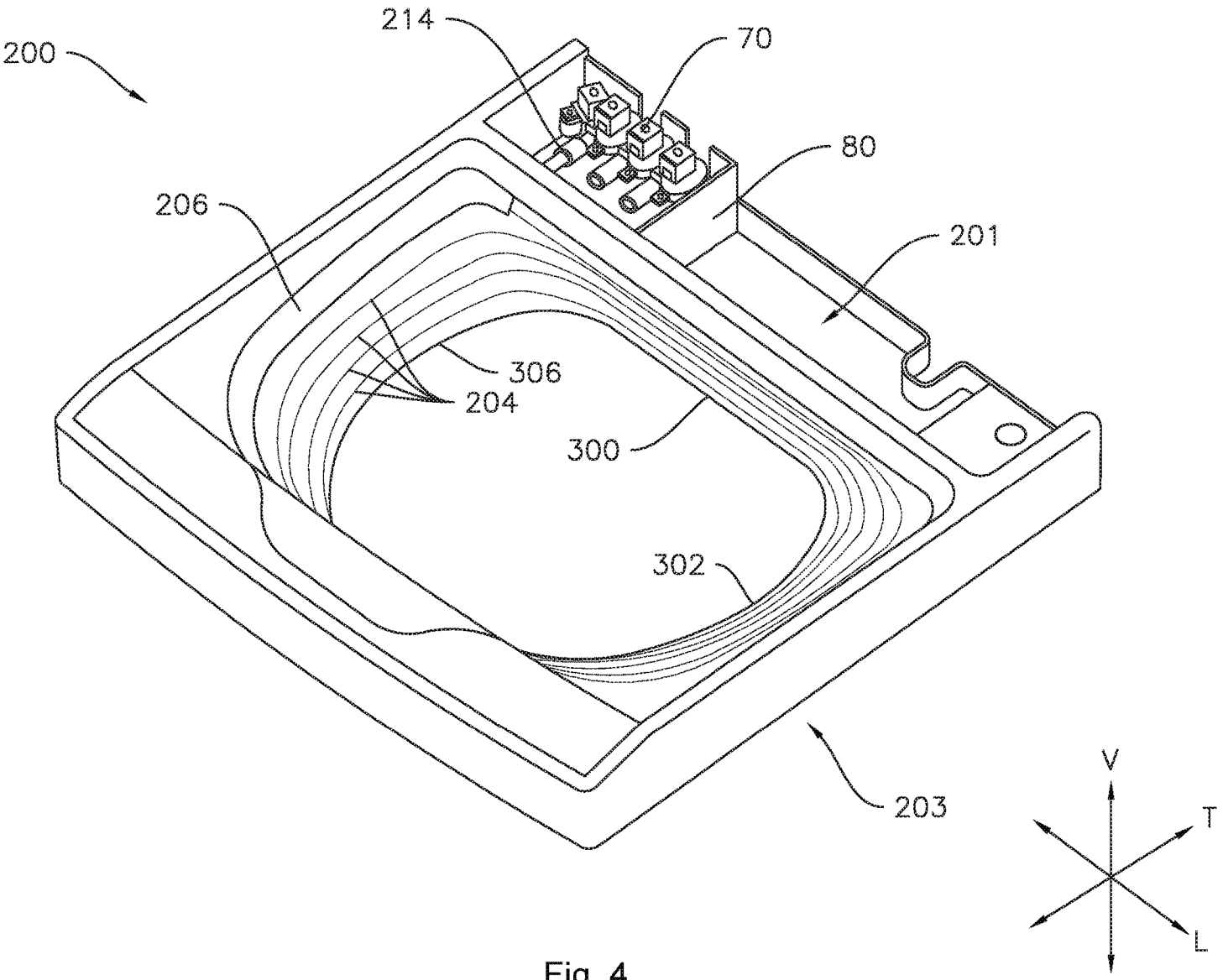
FIG. 4 provides a perspective view of an exemplary top panel according to one or more embodiments of the present subject matter.
Figure 5:
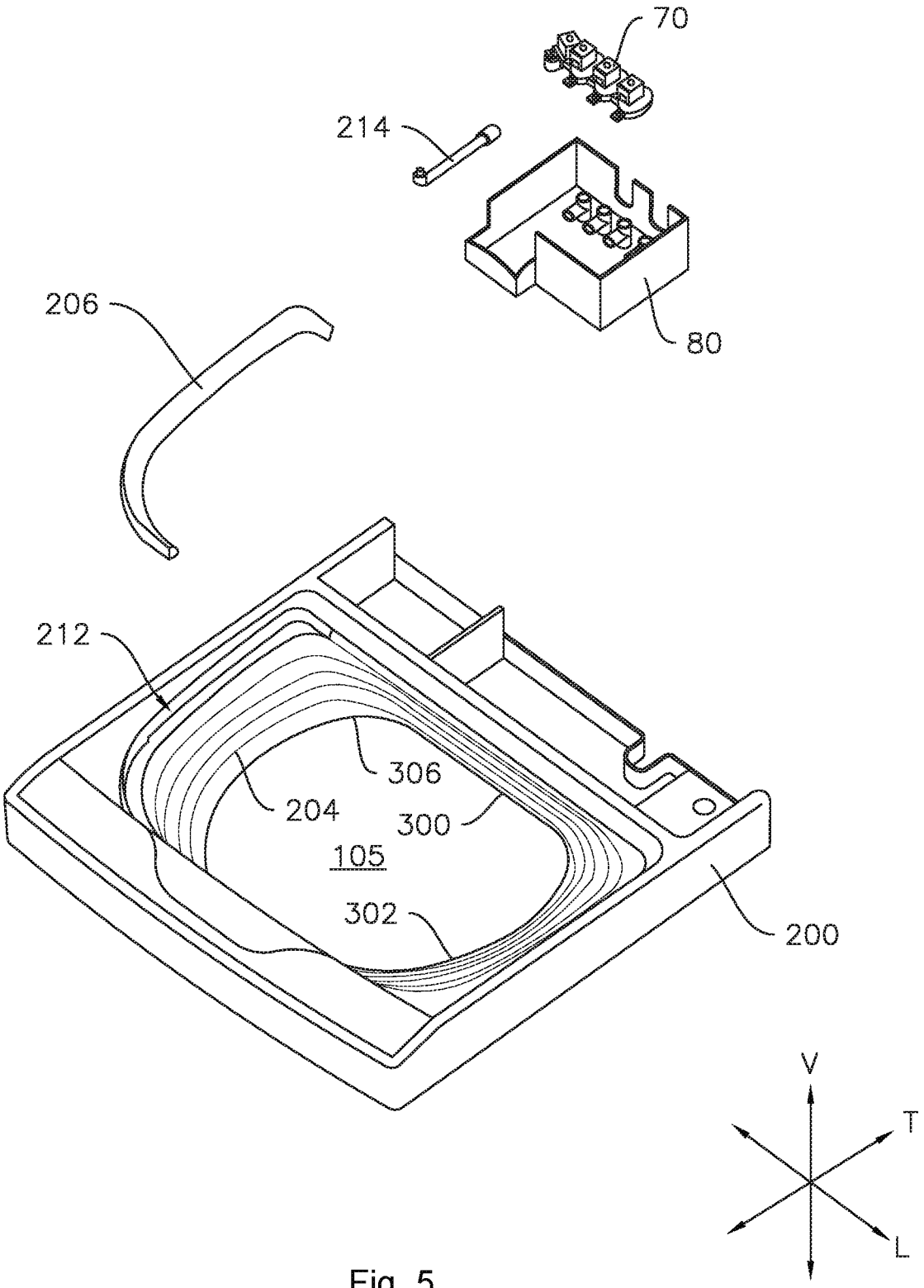
FIG. 5 provides an exploded view of the exemplary top panel of FIG. 4.
Figure 6:
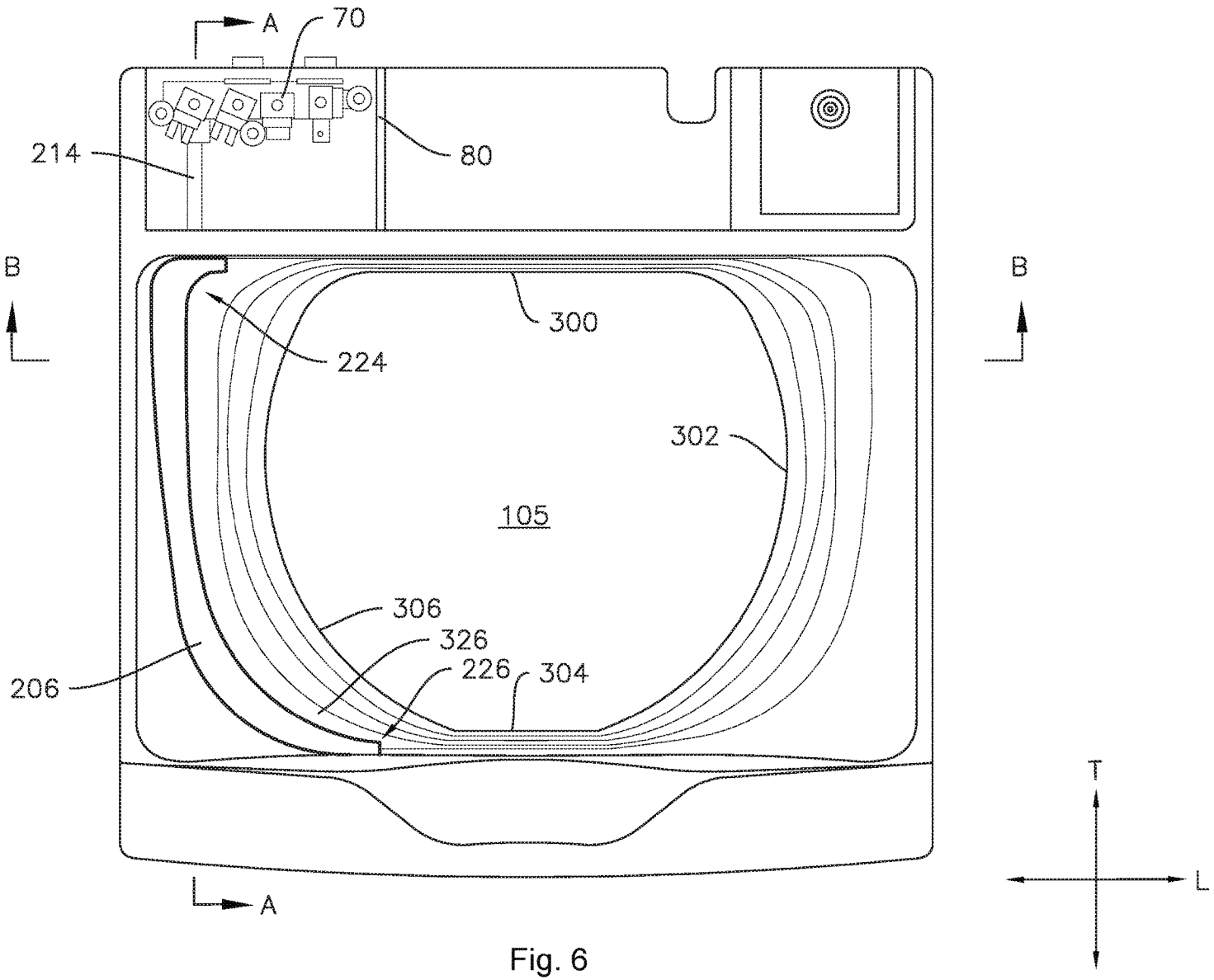
FIG. 6 provides a top view of the exemplary top panel of FIG. 4.
Figure 7:
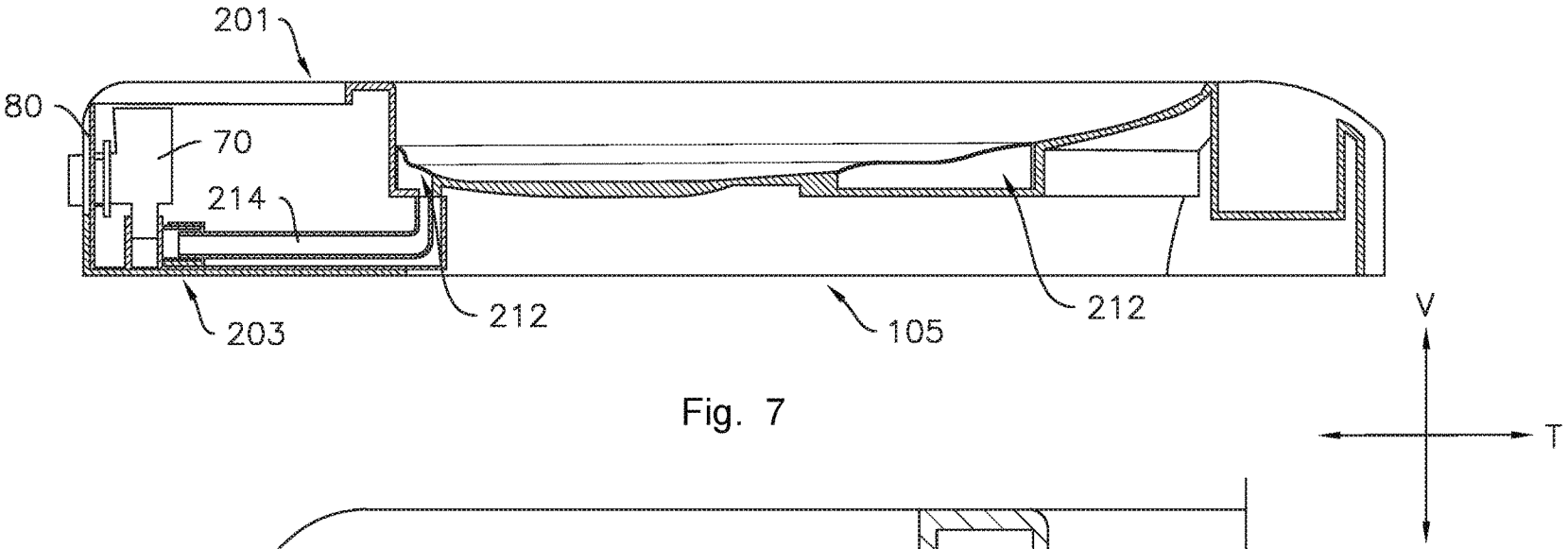
FIG. 7 provides a side (transverse) section view of the exemplary top panel of FIG. 4.
Figure 8:
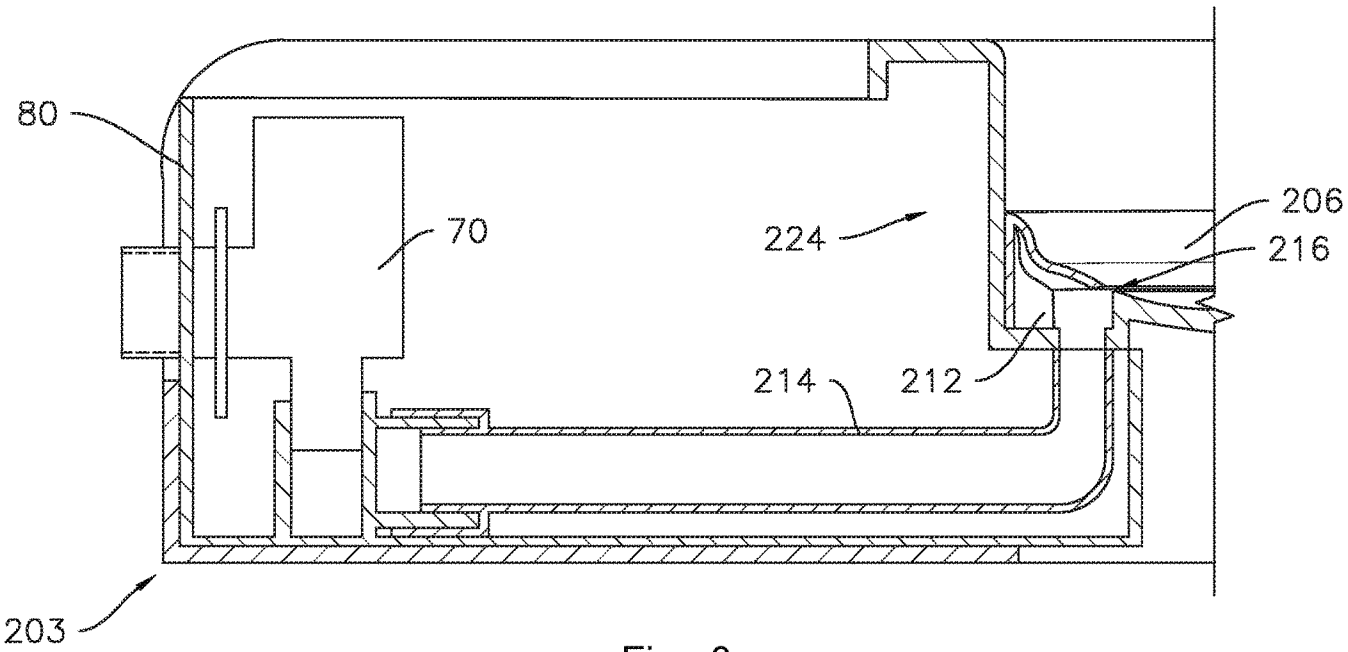
FIG. 8 provides an enlarged view of a portion of FIG. 7.

As may be seen, e.g., in FIGS. 4 and 5, the washing machine appliance 100 may also include an elongated nozzle 206. As used herein, the nozzle 206 is considered "elongated" in that a length of the nozzle 206, e.g., along one or both of the lateral direction L and the transverse direction T when the elongated nozzle 206 is installed in the top cover 200, is much greater than a height of the nozzle 206 along the vertical direction V, as will be described in more detail below. For example, the length of the nozzle 206 may be one or more orders of magnitude greater than a height H of an outlet 216 defined by the nozzle 206, as described in more detail below. The elongated nozzle 206 may be positioned in the top panel 200 proximate the top 201 of the top panel 200 and below the door 130, e.g., as seen in FIG. 3. The elongated nozzle 206 is configured to provide a sheet flow of wash fluid over the pretreatment area 202. As seen in FIGS. 4 through 6, the elongated nozzle 206 is connected to a water source (not shown) via a valve 70. As best seen in FIGS. 7 and 8, a connector 214 extends between the valve 70 and an upstream end 224 of the elongated nozzle 206. The valve 70 may be positioned in a valve box 80. The water source may include, for example, a municipal water supply and/or a hot water heater such that hot water, cold water, or water at an intermediate temperature may be supplied to the elongated nozzle 206.

As best seen in FIG. 6, the aperture 105 may comprise a plurality of sides. For example, as illustrated in FIG. 6, the aperture 105 may include a first side 300, a second side 302, a third side 304, and a fourth side 306. For example, the first side 300 may be a first linear or straight side extending along a rear portion of the aperture 105, as in the illustrated embodiment of FIG. 6. The second side 302 may be a first curvilinear or curved side extending along a right portion of the aperture 105. Further, the third side 304 may be a second straight side extending along a front portion of the aperture 105 and the fourth side 306 may be a second curved side extending along a left portion of the aperture 105. As illustrated, the aperture 105 may be continuous along and between each of the sides 300, 302, 304, and 306. In various embodiments, an aperture 105 having any suitable number and shape (e.g., straight or curved) of sides may be provided.

In various embodiments, the elongated nozzle 206 may fully encompass at least one of the sides 300, 302, 304, and 306 of the aperture 105. For example, in the illustrated embodiment of FIG. 6, the elongated nozzle 206 fully encompasses fourth side 306 of aperture 105. As another example, in the illustrated embodiment of FIGS. 11 through 16, the elongated nozzle 206 fully encompasses the second side 302, the third side 304, and the fourth side 306. In various embodiments, the elongated nozzle 206 may fully encompasses any one or more of the sides 300, 302, 304, and 306. For example, the elongated nozzle 206 may fully encompasses the second side 302 and/or the third side 304.

Figure 9:
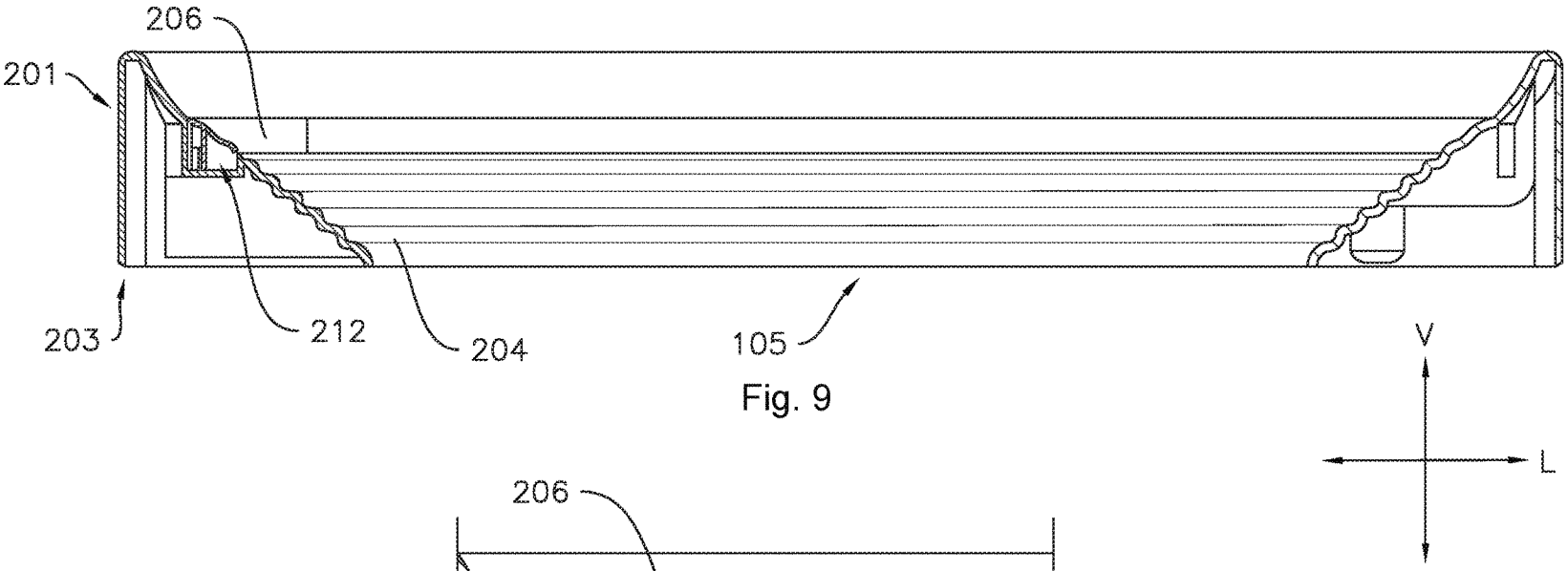
FIG. 9 provides a front (lateral) section view of the exemplary top panel of FIG. 4.
Figure 10:
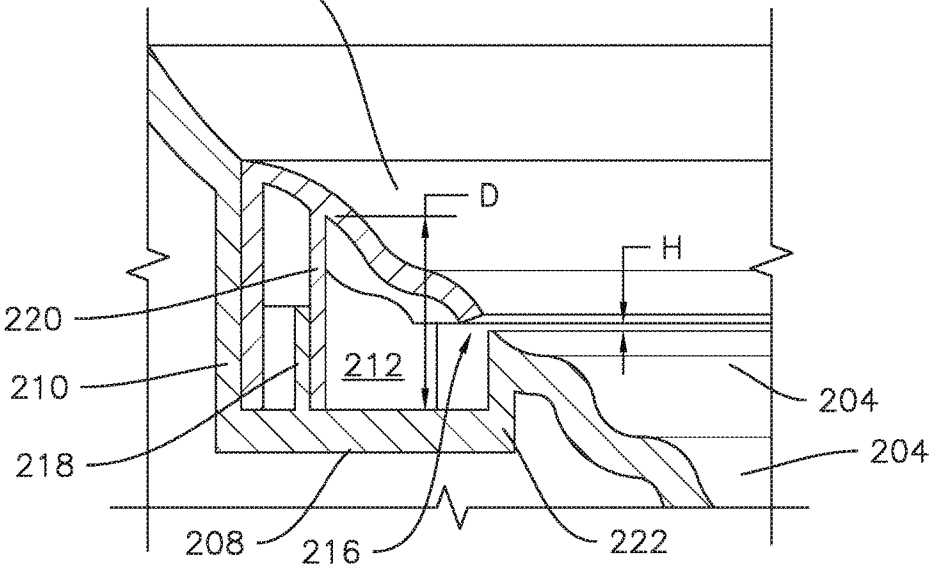
FIG. 10 provides an enlarged view of a portion of FIG. 9.
Figure 11:
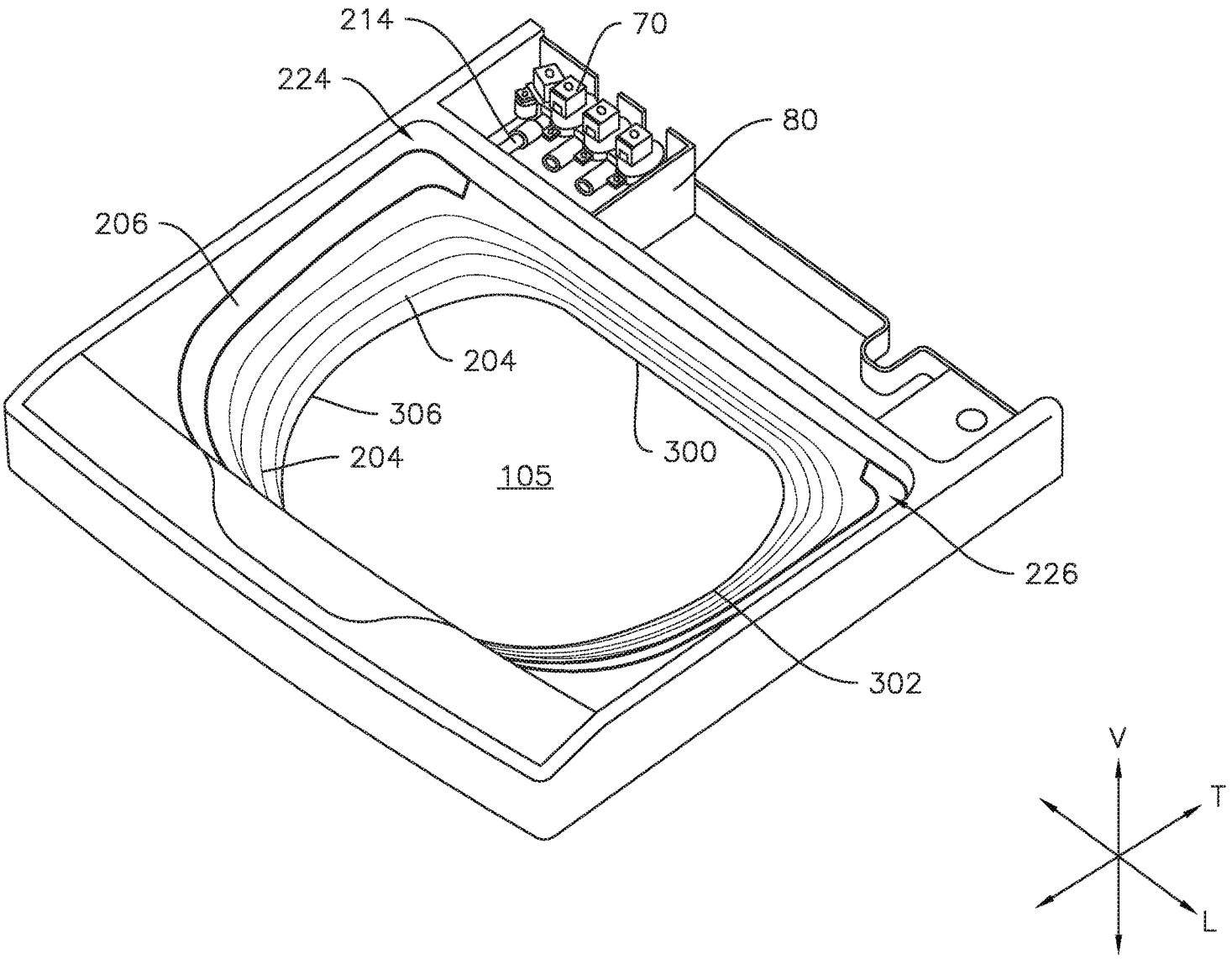
FIG. 11 provides a perspective view of an exemplary top panel according to one or more additional exemplary embodiments of the present subject matter.

As best seen in the enlarged view of FIG. 8, an outlet 216 is defined between the elongated nozzle 206 and the top panel 200. A flow channel 212 is defined in the top panel 200 upstream of the outlet 216. More particularly, as best seen in FIGS. 8 and 10, the flow channel 212 is defined between the elongated nozzle 206 and a first wall 208 and a second wall 222 of the top panel 200. In some embodiments, for example as illustrated in FIG. 9, the flow channel 212 extends along only one side of the top panel 200. As best seen in the enlarged view of FIG. 10, a depth D of the flow channel 212 is substantially larger than a height H of the outlet. As a result of the relatively small size of the outlet 216, the channel 212 may be filled and pressurized with a wash fluid, e.g. water, before the fluid exits the channel 212 at the outlet 216. When water or other wash fluid is supplied to the channel 212, such that channel 212 is pressurized and filled with the fluid, such fluid may form a sheet flow which emanates from the outlet 216.

As shown in FIG. 10, the flow channel 212 may be at least partially defined by a plurality of walls of the top panel 200. For example, in the illustrated embodiments, a plurality of orthogonal walls are formed in the pretreatment area 202 of the top panel 200, including first wall 208, second wall 222, and a third wall 210. The walls 208, 210, and 222 partially define the flow channel 212 with the elongated nozzle 206 when the elongated nozzle 206 is inserted within the top panel 200, e.g., as shown in FIG. 10. Additionally, the elongated nozzle 206 may include a leg 220 and the top panel 200 may include a rib 218 extending from the first wall 208 of the top panel 200. In some embodiments, the leg 220 of the elongated nozzle 206 and the rib 218 of the top panel 200 may be configured to form an interference fit whereby the leg 220 and the rib 218 are sealingly engaged when the nozzle 206 is installed in the top panel 200. Such sealing engagement may advantageously promote pressurizing the channel 212 such that the outlet 216 becomes the path of least resistance for wash fluid in the channel 212 to exit the channel 212.

Figure 12:
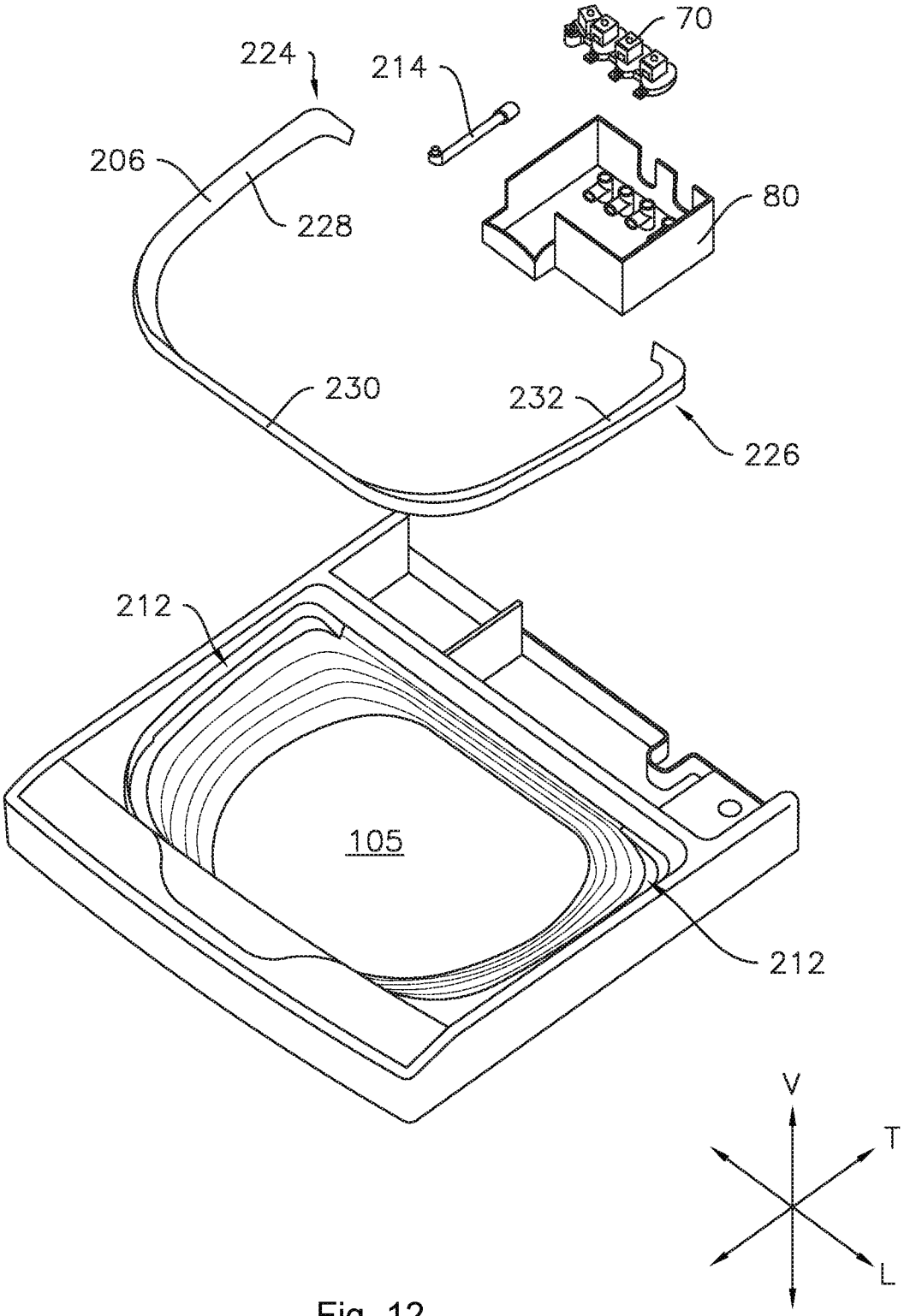
FIG. 12 provides an exploded view of the exemplary top panel of FIG. 11.

As mentioned above, FIGS. 11 through 16 illustrate another exemplary embodiment of the present subject matter, wherein the elongated nozzle 206 extends along three sides of the top panel 200. More particularly, the elongated nozzle 206 extends from upstream end 224 proximate a left rear corner of the top panel 200 to a downstream end 226 proximate a right rear corner of the top panel 200. The left rear corner of the top panel 200 may be defined by the intersection of the left side 106 and the rear side 109 and the right rear corner may be defined by the intersection of the right side 107 and the rear side 109. As shown in FIG. 12, the elongated nozzle 206 may extend from upstream end 224 along a first transverse segment 228, from the first transverse segment 228 along a lateral segment 230, and from the lateral segment 230 to the downstream end 226 along a second transverse segment 232.

Figure 13:
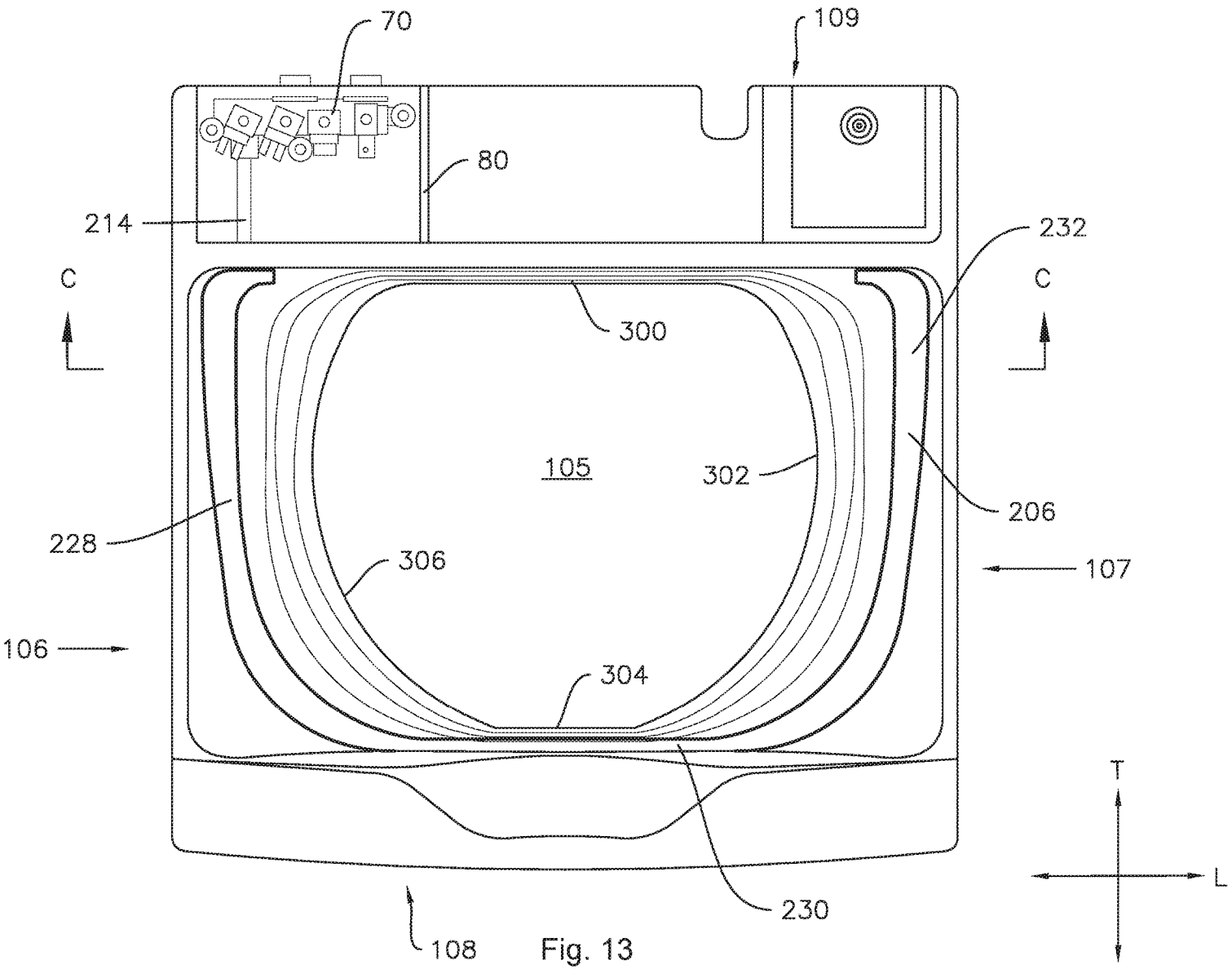
FIG. 13 provides a top view of the exemplary top panel of FIG. 11.

As best seen in FIG. 13, when the elongated nozzle 206 is installed in the top panel 200, an intersection or transition between the first transverse segment 228 and the lateral segment 230 may be at or near a front left corner of the top panel 200 defined by an intersection of the left side 106 and the front side 108, and an intersection or transition between the lateral segment 230 and the second transverse segment 232 may be at or near a front right corner of the top panel 200 defined by an intersection of the right side 107 and the front side 108. Accordingly, in such embodiments, the fourth side 306 of the aperture 105 is fully encompassed by the first transverse segment 228 of the elongated nozzle 206, the third side 304 of the aperture 105 is fully encompassed by the lateral segment 230 of the elongated nozzle 206, and the second side 302 of the aperture 105 is fully encompassed by the second transverse segment 232 of the elongated nozzle 206.

Figure 14:
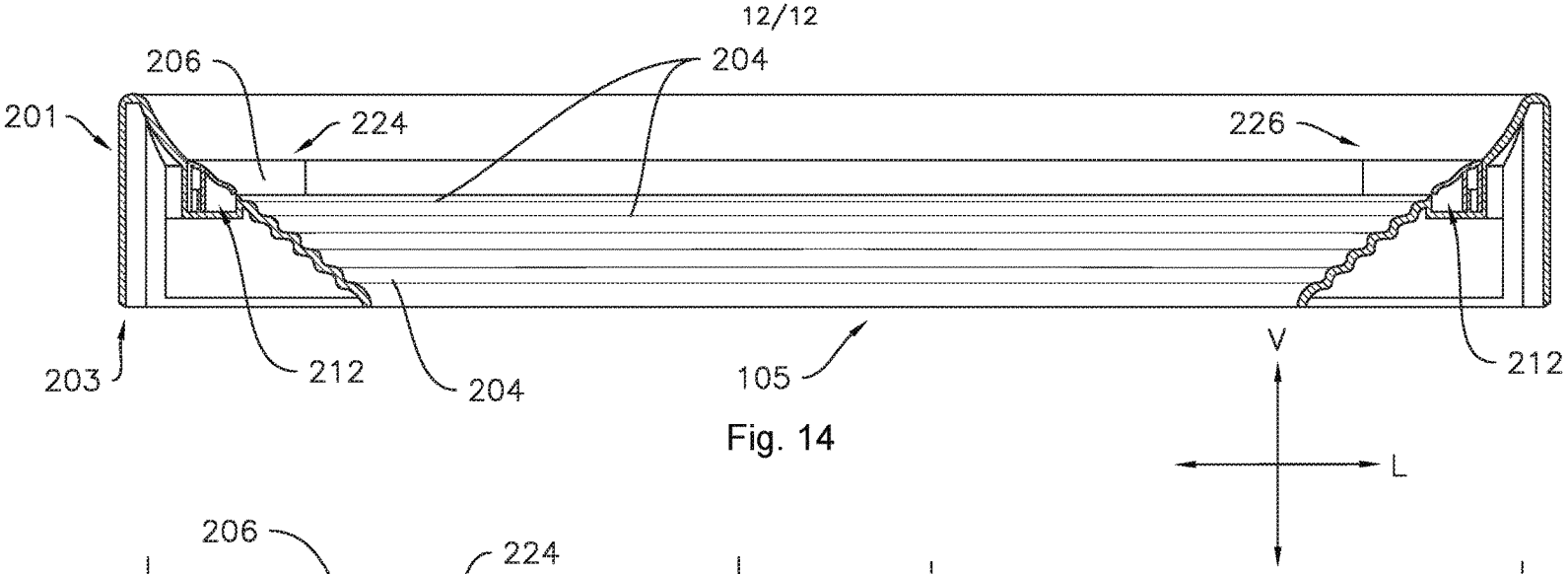
FIG. 14 provides a front (lateral) section view of the exemplary top panel of FIG. 11.
Figure 15:
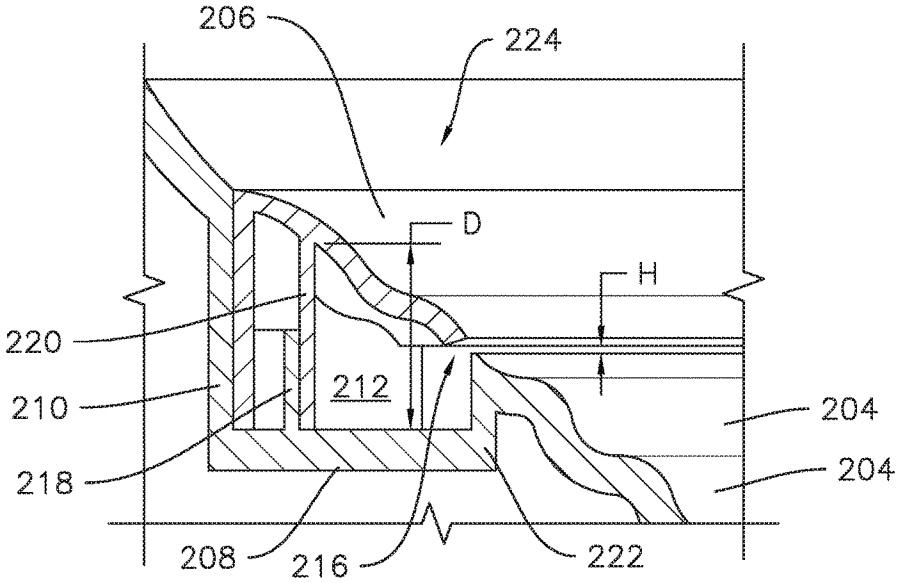
FIG. 15 provides an enlarged view of a portion of FIG. 14.
Figure 16:
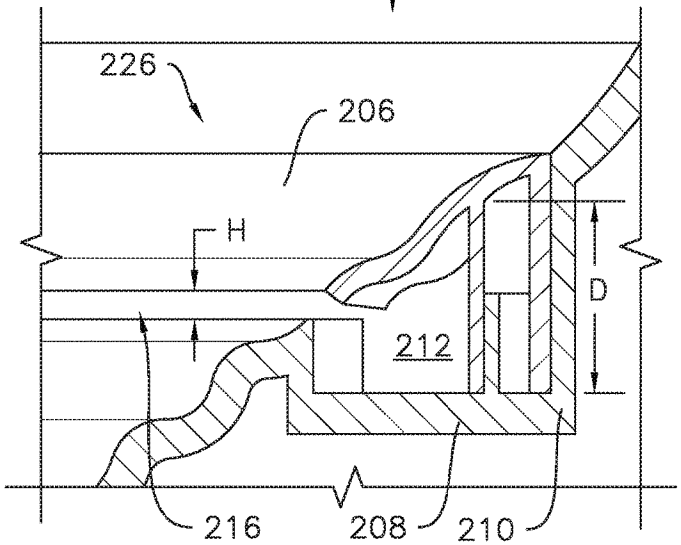
FIG. 16 provides an enlarged view of a portion of FIG. 14.

As may be seen, e.g., in FIG. 14, the pretreatment area 202 tapers inwardly from the top panel 200 towards an interior of the cabinet 102. For example, as shown in FIG. 14, the pretreatment area 202 extends downward along the vertical direction V from the top 201 of the top panel 200 to the aperture 105 at the bottom 203 of the top panel 200. Also as shown in FIG. 14, the pretreatment area 202 tapers inward along the lateral direction L at both sides. For example, the pretreatment area 202 extends to the right from the left side 106 and to the left from the right side 107.

As mentioned above, the outlet 216 defines a height H along the vertical direction V. As best seen by comparing FIGS. 15 and 16, the height H of the outlet 216 increases from the upstream end 224 of the elongated nozzle 206 to the downstream end 226 of the elongated nozzle 206. For example, the height H may increase continuously along the length of the elongated nozzle 206 from the upstream end 224 to the downstream end 226. As mentioned above, the flow channel 212 may be filled with wash fluid, e.g., water, before the sheet flow of fluid will begin to emanate from the outlet 216. The pressure within the channel 212 may be greater at the upstream end 224 and may be less at the downstream end 226 than at the upstream end 224. As such, providing a smaller height H of the outlet 216 at the upstream end 224 and a larger height H of the outlet 216 at the downstream end 226, e.g., providing an outlet 216 with a height H that varies inversely to the obtainable fluid pressure within the channel 212, may serve to promote formation of an evenly distributed sheet flow from the outlet 216. It should be understood that the height H of the outlet 216 may increase from the upstream end 224 to the downstream end 226 of the elongated nozzle 206 in several embodiments, e.g., the embodiments of FIGS. 2 through 10 wherein the elongated nozzle 206 encompasses less than three sides of the aperture 105 may also include an outlet 216 which increases in height H from the upstream end 224 to the downstream end 226.

Accordingly, the elongated nozzle 206 as described in the exemplary embodiments herein, may be configured, e.g., sized and shaped, to provide a sheet flow of wash fluid over and through the pretreatment area 202. One of ordinary skill in the art will recognize that such "sheet flow" refers to a thin, continuous, and generally uniform layer or film of wash fluid passing over the ridges 204 within the pretreatment area 202 and flowing down the slope of the pretreatment area 202 directly into the wash chamber 121 via the aperture 105.

A control panel 110 with a plurality of input selectors 112 (FIG. 1) extends from top panel 200. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device 150 that is operatively coupled to control panel 110 for user manipulation to select washing machine cycles and features. In response to user manipulation of control panel 110 the controller 150 operates the various components of washing machine appliance 100 to execute selected machine cycles and features. For example, the controller 150 may be in communication with (e.g., electrically coupled to) the input selectors 112 for user manipulation to select washing machine cycles and features. As illustrated, the input selectors 112 may be knobs or dials. In various embodiments, the input selectors 112 may include one or more user input devices, such as switches, buttons, touchscreen interfaces, etc., as well as or instead of the illustrated example input selectors 112. Appliance controller 150 may further be in communication with (e.g., electrically coupled to) various other components of appliance 100, such as one or more valves, one or more suitable sensors, etc.

Appliance controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, appliance controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100, such as the door 130, one or more valves, one or more sensors, etc. may be in communication with appliance controller 150 via one or more signal lines or shared communication busses. It should be noted that controllers 150 as disclosed herein are capable of and may be operable to perform any methods and associated method steps as disclosed herein. For example, in some embodiments, methods disclosed herein may be embodied in programming instructions stored in the memory and executed by the controller 150.

In an illustrative embodiment, laundry items may be loaded into wash chamber 121 through aperture 105, e.g., after pretreating one or more of the laundry items in the pretreatment area 202 as described above, and washing operation may be initiated through operator manipulation of input selectors 112. Wash basket 120 (and/or wash tub 124 shown in FIG. 3) may be filled with water and detergent to form a wash fluid. As used herein, "wash fluid" may refer to water, detergent, fabric softener, bleach, or any other suitable wash additive or combination thereof. One or more valves can be controlled by controller 150 to provide for filling wash basket 120 to the appropriate level for the amount of articles being washed. Once wash basket 120 is properly filled with fluid, the contents of wash chamber 121 are agitated for cleansing of laundry items in wash basket 120.

After the agitation phase of the wash cycle is completed, wash basket 120 may be drained. Laundry articles can then be rinsed by again adding fluid to wash basket 120, depending on the particulars of the cleaning cycle selected by a user, impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 105.

Wash tub 124 is configured for containing fluid, e.g., wash and rinse fluids, during operation of washing machine appliance 100 described above. Wash and rinse fluids disposed within wash tub 124 can be used to clean articles disposed in wash basket 120. Wash and rinse fluids can pass between wash basket 120 and wash tub 124 through a plurality of apertures defined by wash basket 120, e.g., during the wash and/or spin cycles described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the vertical direction, the lateral direction and the transverse direction are mutually perpendicular, the washing machine appliance comprising:

a cabinet extending between a top and a bottom along the vertical direction;

a wash tub mounted within the cabinet and configured for containing fluid during operation of the washing machine appliance;

a wash basket rotatably mounted within the wash tub, the wash basket defining a wash chamber configured for receiving laundry articles;

a top panel positioned at the top of the cabinet, the top panel extending from a top of the top panel to a bottom of the top panel along the vertical direction;

a door mounted to the cabinet at the top of the top panel;

an aperture defined in the bottom of the top panel, the aperture positioned directly over the wash basket along the vertical direction, the aperture sized and configured for passing laundry articles therethrough into the wash chamber of the wash basket;

a pretreatment area defined in the top panel between the door and the aperture along the vertical direction;

an elongated nozzle positioned in the top panel proximate the top of the top panel and below the door, the elongated nozzle configured to provide a sheet flow of wash fluid over the pretreatment area;

an outlet defined between the elongated nozzle and the top panel, wherein the sheet flow emanates from the outlet; and a flow channel defined in the top panel upstream of the outlet, wherein the flow channel is defined between the elongated nozzle and a first wall and a second wall of the top panel;

wherein the elongated nozzle comprises a leg and the top panel comprises a rib extending from the first wall of the top panel, and wherein the leg of the elongated nozzle and the rib of the top panel are configured to form an interference fit whereby the leg and the rib are sealingly engaged.

2. The washing machine appliance of claim 1, wherein the aperture comprises a plurality of sides, and the elongated nozzle fully encompasses at least one side of the aperture.

3. The washing machine appliance of claim 1, further comprising a plurality of ridges within the pretreatment area.

4. The washing machine appliance of claim 1, wherein a depth of the flow channel is substantially larger than a height of the outlet.

5. The washing machine appliance of claim 1, wherein the outlet defines a height along the vertical direction, the height of the outlet increasing from an upstream end of the elongated nozzle to a downstream end of the elongated nozzle.

6. A washing machine appliance comprising:

a cabinet having a top panel defining an aperture;

a wash tub mounted within the cabinet below the top panel and configured for containing fluid during operation of the washing machine appliance;

a wash basket rotatably mounted within the wash tub directly below the aperture of the top panel, the wash basket defining a wash chamber configured for receiving laundry articles via the aperture in the top panel;

a door mounted to the cabinet at the top of the top panel;

a pretreatment area defined in the top panel between the door and the aperture;

an elongated nozzle positioned in the top panel proximate to and below the door, the elongated nozzle configured to provide a sheet flow of wash fluid over the pretreatment area;

an outlet defined between the elongated nozzle and the top panel, wherein the sheet flow emanates from the outlet; and a flow channel defined in the top panel upstream of the outlet, wherein the flow channel is defined between the elongated nozzle and a first wall and a second wall of the top panel;

wherein the elongated nozzle comprises a leg and the top panel comprises a rib extending from the first wall of the flow channel, and wherein the leg of the elongated nozzle and the rib of the top panel are configured to form an interference fit whereby the leg and the rib are sealingly engaged.

7. The washing machine appliance of claim 6, wherein the aperture comprises a plurality of sides, and the elongated nozzle fully encompasses at least one side of the aperture.

8. The washing machine appliance of claim 6, further comprising a plurality of ridges within the pretreatment area.

9. The washing machine appliance of claim 6, wherein a depth of the flow channel is substantially larger than a height of the outlet.

10. The washing machine appliance of claim 6, wherein the outlet defines a height along the vertical direction, the height of the outlet increasing from an upstream end of the elongated nozzle to a downstream end of the elongated nozzle.

* * * * *